United States Patent [19]

Rogers et al.

[11] Patent Number: 4,534,191

[45] Date of Patent: Aug. 13, 1985

[54] SECURITY LOCK FOR SLIDING DOORS

[75] Inventors: John Rogers; Malcolm J. White, both of Staffordshire, England

[73] Assignee: Chuck & Son's Lock and Safe Co., London, England

[21] Appl. No.: 501,939

[22] Filed: Jun. 7, 1983

[30] Foreign Application Priority Data

Jun. 9, 1982 [GB] United Kingdom ..... 8216726

[51] Int. Cl.[3] ..... E05B 63/14

[52] U.S. Cl. ..... 70/116; 70/136; 70/339

[58] Field of Search ..... 292/30, 53, 5, 8, 11, 292/27, 49; 70/116, 123, 136, 137, 143, 339, 355

[56] References Cited

U.S. PATENT DOCUMENTS

| | | | |
|---|---|---|---|
| 512,139 | 2/1894 | Willard | 70/99 |
| 600,584 | 3/1898 | Kaye | 70/100 |
| 913,459 | 2/1909 | Bily | 70/355 |
| 1,067,187 | 7/1913 | Mueller | 70/355 X |
| 1,568,663 | 1/1926 | Fuber | 70/355 |
| 2,720,774 | 10/1955 | Gehrie | 292/27 X |
| 4,239,268 | 12/1980 | Rider | 292/5 |
| 4,332,153 | 6/1982 | Miles | 70/355 X |

FOREIGN PATENT DOCUMENTS

| | | | |
|---|---|---|---|
| 312758 | 9/1918 | Fed. Rep. of Germany | 70/143 |
| 732 | of 1908 | United Kingdom | 70/99 |

*Primary Examiner*—Gary L. Smith
*Assistant Examiner*—Russell W. Illich
*Attorney, Agent, or Firm*—Pollock, Vande Sande and Priddy

[57] ABSTRACT

A security lock for use on sliding doors or gates has a pair of hook bolts which are thrown apart or withdrawn together according to the position of a head on a reciprocable slide. Each bolt has a recess mated to the head with front and rear driving surfaces, this geometry being related to the pivot points of the bolts such that the head drives the bolts positively between their thrown and withdrawn positions with no lost motion and without the need for spring-biasing of the bolts. The slide is deadlocked by a pack of levers, to which a second lever pack is linked, two lever packs being provided so that non-palindromic key-stepping can be employed. If required, the slide can be double-thrown by successive use of two different correct keys, for which different key-hole positions and are provided to cooperate with the lever packs.

8 Claims, 2 Drawing Figures

SECURITY LOCK FOR SLIDING DOORS

The present invention relates to locks and particularly, though not exclusively, is concerned with high security key-operated locks for sliding doors, gates or the like.

In accordance with one aspect of the invention a lock comprises: a pair of hook bolts arranged to be pivoted in mutually opposite senses between unlocking and locking positions; a reciprocable slide arranged to be moved between first and second positions in response to corresponding turning movement of a correct key; the slide being arranged to be thrust against respective first portions of the bolts during movement from its first to its second said position thereby to pivot the bolts from their unlocking to their locking positions, a portion of the slide lying between the bolts when the slide is in its second said position thereby to prevent pivotal movement of the bolts from their locking to their unlocking positions, and the slide being arranged to engage respective second portions of the bolts during movement from its second to its first said position thereby to pivot the bolts from their locking to their unlocking positions; and a key-recognition mechanism comprising a plurality of movable detainers (preferably levers) arranged to be set in predetermined relative positions when engaged by a correct key, the detainers serving to block the aforesaid movement of the slide except when they are set in their said predetermined relative positions.

In a preferred feature of the invention the slide is arranged to pivot the bolts in both senses between their unlocking and locking positions substantially without lost motion between the slide and bolts, and without the application of springs or other additional biasing means to influence the movement of the bolts. The slide may include a head having a leading portion which is thrust against the said first portions of the bolts to pivot the bolts from their unlocking to their locking positions and a trailing portion which is thrust against the said second portions of the bolts to pivot the bolts from their locking to their unlocking positions; said head being the portion of the slide which lies between the bolts when the slide is in its second said position.

The aforesaid slide may be arranged to be moved also between its second said position and a third position in which a portion of the slide remains between the bolts to maintain the prevention of pivotal movement of the bolts from their locking to their unlocking positions; and it is preferably arranged that a first correct key is effective to move the slide between its first and second positions and a second correct key (but not the first correct key) is effective to move the slide between its second and third positions.

Figure 1:
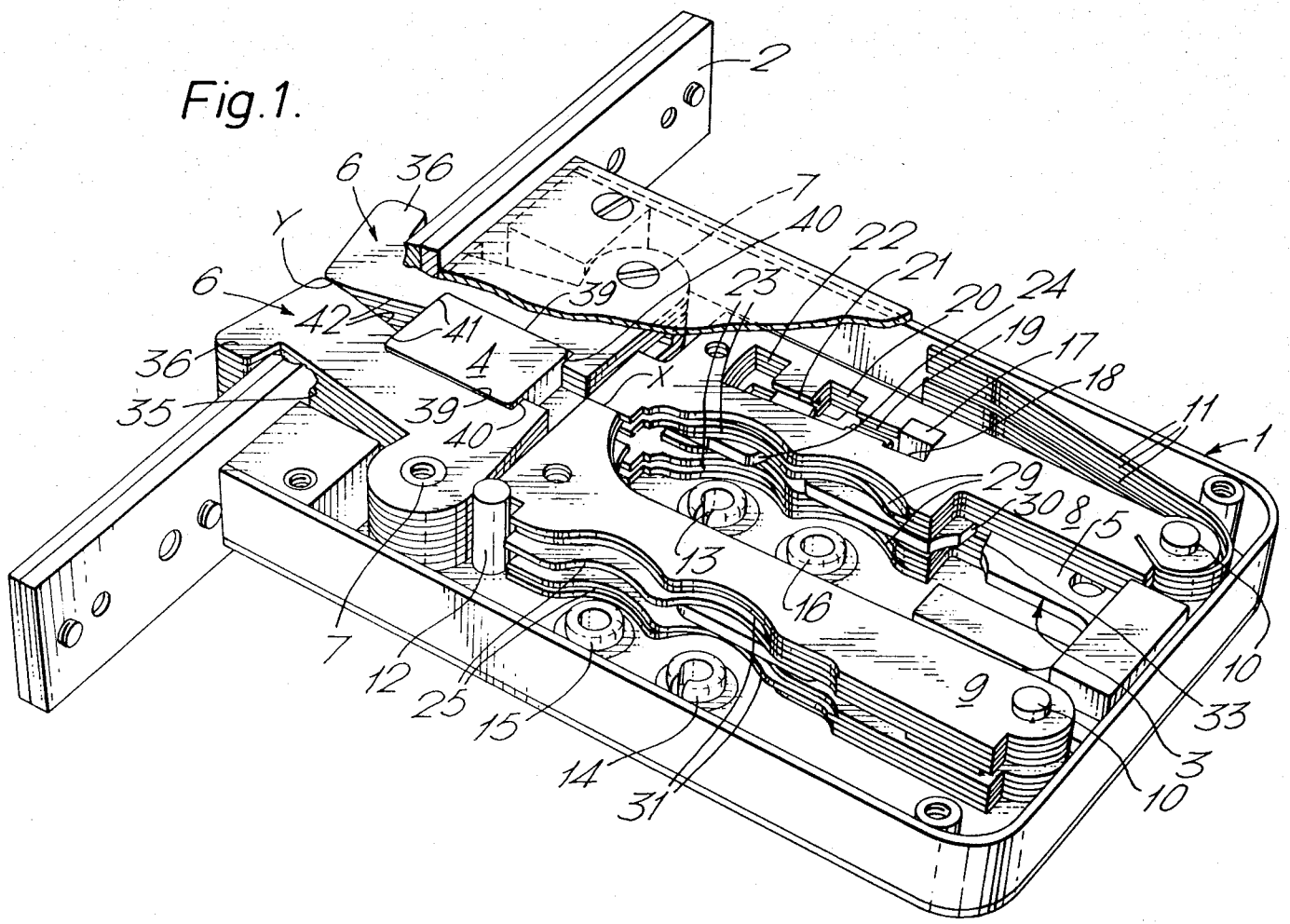
Figure 2:
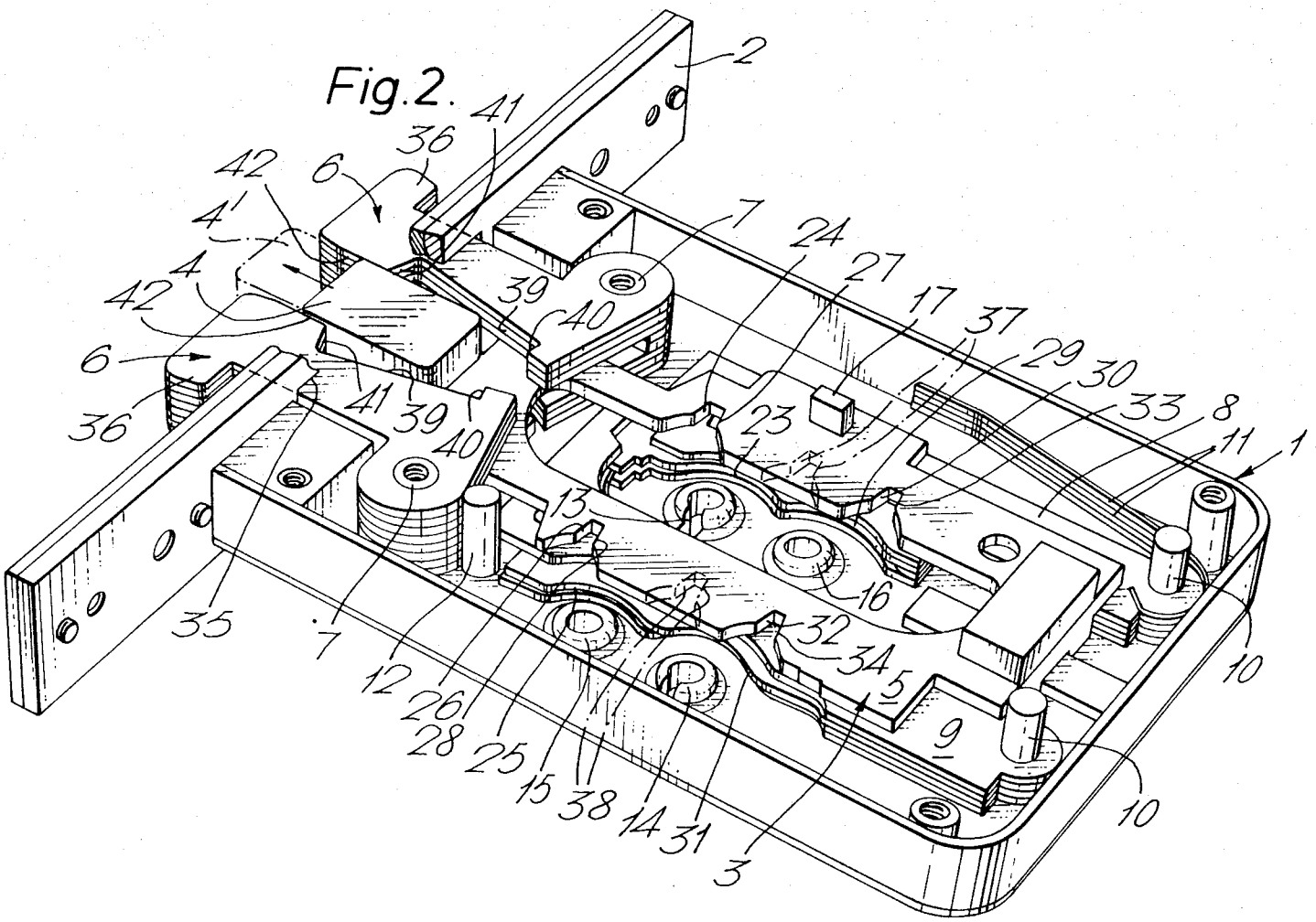

An illustrative embodiment of the invention, in the form of a mortice lock for a sliding door, will now be more particularly described with reference to the accompanying drawings, in which:

FIG. 1 is a perspective view of the lock mechanism in its inoperative condition, with part of the lock case removed; and FIG. 2 is a view similar to FIG. 1 of the lock mechanism in an operative condition, with some of the levers omitted for clarity of illustration.

In the following description all expressions of relative direction or position, such as "clockwise", "anticlockwise", "upper", "lower", "leftwards", "rightwards", "near side", and "far side" are given in terms of the lock as viewed from the standpoint of the Figures.

Referring to FIG. 1, the illustrated lock has a case 1 and forend 2. A slide 3 is borne within the case for rectilinear motion, this slide having a head 4 and an apertured, platelike tail 5. A pair of hook bolts 6 are pivoted on respective pins 7 within the case and cooperate with the head 4 of the slide as will be more fully described hereafter. The lock also incudes two packs of levers 8 and 9 pivoted on respective pins 10, with levers in both packs being disposed to either side of the central slide tail 5. Each lever pack contains the same number of levers and those in the upper pack 8 normally rest upon respective members of the lower pack 9 at a position remote from the pivot pins 10, as indicated at X, with each lever pair being resiliently biased downwardly by a respective spring 11, so that the lower levers normally rest upon a stop pin 12.

In the particular form of lock shown in the Figures the slide 3 can be double-thrown, and two separate keys (which, for convenience, we shall refer to as "servant" and "master" keys respectively) are required in order to achieve this action. More particularly the servant key can throw the slide from its withdrawn (first) position illustrated in FIG. 1 to an intermediate (second) position in which the head 4 of the slide extends to pivot the bolts 6 as shown in FIG. 2, and can return the slide from its second to its first position; the master key can throw the slide from its second position to its double-thrown (third) position in which the head 4 extends further (as indicated at 4' in FIG. 2) and maintains the bolts 6 in their locking positions, and can return the slide from its third to its second position; but the servant key must be incapable of moving the slide in either sense between its second and third positions, and the master key must be incapable of moving the slide in either sense between its first and second positions. The lock is operable from either side of the door in which it is mounted but, for increased security, a non-palindromic lever sequence is employed. It is for this reason that the two lever packs are required. There are moreover four separate key-entrance positions to the lock, that is to say one each for both keys on both sides of the lock. In FIG. 1 the keyholes through the far side of the lock case for the servant and master keys are indicated at 13 and 14 respectively, the keyholes through the near side of the lock case for the servant and master keys being positioned opposite the plugs indicated at 15 and 16 respecitvely. The two keys are of different cross-sectional forms, with correspondingly shaped keyholes, so as normally to prevent either key being inserted into a keyhole intended for the other.

In the inoperative condition of the lock, as shown in FIG. 1, the slide 3 is deadlocked by the positioning of a transverse stump 17, extending from both sides of the tail 5, within a first pocket 18 of each of the upper levers 8. In order to move the slide 3 from this first position to its second position the upper levers must all be lifted by the correct respective distances to align a respective first gate 19 with the stump 17, to allow the latter to move into a second pocket 20 in each lever 8. Then, in order to move the slide into its third position the upper levers must be lifted by the correct distances to align a respective second gate 21 with the stump 17, to allow the latter to move into a third pocket 22 in each lever 8. The gates 19 and 21 are, of course, at different heights for different levers and furthermore the two gates in each individual lever are at different heights, so that differently-stepped servant and master keys are required to position the levers 8 as appropriate for movement of the slide between its first and second positions, and second and third positions, respectively, and by this means it is ensured that neither key is able to achieve the function assigned to the other.

Considering the operation of the lock in more detail, and first in terms of operation with the servant key from the far side of the lock to single-throw the slide 3, the key bit is passed through the hole 13 and given one complete anticlockwise revolution. As the key turns its bit engages the respective bellies 23 of the upper levers 8 to lift those levers, against the bias of the springs 11, by the correct distances to align the gates 19 with the stump 17 and further turning of the key engages the central bolt step of its bit with a talon form 24 (see also FIG. 2) on the slide tail 5 to shift the slide leftwards into its second position, in so doing the stump 17 passing through the aligned gates 19 and into the second pocket 20 in each lever 8. During the final part of its revolution, the key bit releases the levers 8 to move down under the bias of the springs 11 and re-deadlock the slide in its second position with the stump 17 within the pockets 20. Equivalent operation from the near side of the lock involves passing the servant key bit through the hole opposite plug 15 and turning it anticlockwise to lift the lower levers 9 by engagement with their respective bellies 25 to lift the upper levers 8 by the same distances as before, through their abutting connections with the lower levers, and to shift the slide 3 by engagement with its talon form 26 (FIG. 2). It will be appreciated that for the same (non-palindromic) key to correctly lift the levers 8 through the levers 9, from the near side of the lock, the belly heights of the lower levers are in the reverse sequence to those of the upper levers. To return the slide from its second to its first position the servant key is inserted through the respective servant keyhole, depending of course on which side of the lock the keyholder is located, and turned clockwise to realign the gates 19 with the stump 17 and to shift the slide rightwards, by engagement with a talon form 27 or 28 (FIG. 2) as appropriate.

Assuming now that the slide 3 is in its second position shown in FIG. 2 and it is required to double-throw the slide to its third position, from the near side of the lock, the bit of the master key is passed through the hole opposite plug 16 and given one complete anticlockwise revolution. As the key bit turns it engages a respective second belly 29 of each upper lever 8 to lift those levers, against the bias of the springs 11, by the correct distances to align the gates 21 with the stump 17, which in this condition of the lock lies within the pockets 20. Further turning of the key bit engages its bolt step with a talon form 30 on the slide tail 5 to shift the slide leftwards into its third position, in so doing the stump 17 passing through the aligned gates 21 and into the third pocket 22 of each lever 8. During the final part of its revolution the key bit releases the levers 8 to move down under the bias of the springs 11 and re-deadlock the slide in its third position with the stump 17 within the pockets 22. Equivalent operation from the far side of the lock involves passing the master key bit through the hole 14 and turning it anticlockwise to lift the lower levers 9 (and thereby the upper levers 8), by engagement with respective bellies 31, and to shift the slide by engagement with a further talon form 32 (FIG. 2). Return movement of the slide from its third to its second position is achieved by a clockwise revolution of the master key bit passed through the respective master keyhole to re-align the gates 21 with the stump 17 and to shift the slide rightwards by engagement with a talon form 33 or 34 as appropriate.

Turning now to the arrangement and function of the bolts 6, each extends from the lock case through an aperture 35 in the forend 2, and terminates at its forward end in a hooked nose portion 36. In the inoperative condition of the lock as shown in FIG. 1, the two bolts 6 are drawn together such that they abut where indicated at Y, and in this condition the noses 36 of the bolts are able to pass through a corresponding aperture in a locking plate (not shown) associated with the door frame, when the door in which the lock is mounted is slid shut. The bolts 6 are held in this condition by the close fit between the rectangular head 4 of the slide 3 and a complementary recess 39 formed in each bolt for the bolt noses to be pivoted away from each other the surface 40 at the tail end of each recess 39 must intrude into the volume occupied by the head in this condition.

Assuming that the lock is now operated by a correct servant key, the slide head 4 is thrust against the surface 41 at the leading end of the recess 39 of each bolt and the bolts are cammed apart by the head as the slide advances into its aforesaid second position, the head 4 substantially simultaneously releasing the trailing recess surfaces 40. At the termination of this action the parts are disposed as shown in FIG. 2; that is, the head 4 is placed between heel portions 42 of the two bolts 6 to block reverse pivotal movement of the bolts, and in this condition the noses 36 will have been placed behind respective marginal portions of the locking plate to prevent opening movement of the door. In this condition the assembly of the head 4 and bolts 6 substantially fills the aperture 35 in the lock forend. Further movement of the slide 3 into its aforesaid third position (if this be required), under the action of a correct master key, causes the head 4 to advance still further between the heel portions 42 of the bolts as indicated at 41 without, however, causing any further movement of the bolts themselves; likewise the bolts 6 remain in the same position during return movement of the slide from its third to its second position.

In order to unlock the door the slide 3 is withdrawn from its second to its first position by operation of a correct servant key. In so doing the trailing end of the head 4 comes into engagement with the bolt surfaces 40 to pivot the bolts back into their FIG. 1 positions, substantially simultaneously with the release of the bolt surfaces 42 by the leading end of the head 4. The bolt noses 36 are thus withdrawn from their locking positions behind the locking plate, and the door can be opened.

The geometry of the bolts 6 is so related to the form and movement of the head 4 that there is substantially no lost motion in the operation of the bolts, that is to say the position of the bolts is at all times directly controlled by the head 4, and the illustrated arrangement permits sure control to be exercised over the bolt movements without the need for any biasing springs on the bolt/-head system. As will be appreciated, the bolt action is particularly secure in that the bolts are pivoted into their locking positions during the very first part of the outward movement of the slide 3, and they are released from their locking positions only during the last fraction of the withdrawing movement of the slide.

The bolts 6 are of laminated construction with the central laminae in each case being partly relieved as shown to accommodate the movements of the slide tail 5. At least one lamina in each bolt is preferably of hardened steel, to resist sawing.

Although the lock as described above is configured to prevent the master key from moving the slide 3 in either sense between its first and second positions, in other embodiments it may be desirable to permit the master key to perform this function in addition to moving the slide between its second and third positions, while still preventing movement of the slide by the servant key between its second and third positions. This can be achieved by providing the two gates 19 and 21 in alignment in each individual lever 8 and providing additional talon forms in the slide tail for the master key, at the chain-line positions indicated at 37 and 38 in FIG. 2. The two keys are now configured with respect to the lever bellies to lift the levers 8 to the same heights (from their respective key hole positions) and the additional talon forms enable the master key to shift the bolt stump 17 in either sense through the gates 19. However, as will be appreciated from FIG. 2, these additional talon forms are spaced from the respective servant key talon forms 24,26,27 and 28 by a distance greater than each throw of the slide 3 so that they are not engageable by the servant key in either the second or third position of the slide, and hence the servant key is still precluded from moving the slide between those two positions.

We claim:

1. A lock comprising: a casing having two opposite faces corresponding to opposite directions of approach to the lock when fitted to a closure; a pair of hook bolts pivoted within said casing and having hook portions extending out of said casing arranged to be pivoted in mutually opposite senses between unlocking and locking position; a reciprocable slide within said casing arranged to be moved between first and second positions in response to corresponding turning movement of a correct key; the slide being arranged to be thrust against respective first portions of the bolts during movement from its first to its second said position thereby to pivot the bolts from their unlocking to their locking positions, a portion of the slide lying between the bolts when the slide is in its second said position thereby to prevent pivotal movement of the bolts from their locking to their unlocking positions, and the slide being arranged to engage respective second portions of the bolts during movement from its second to its first said position thereby to pivot the bolts from their locking to their unlocking positions; and a key-recognition mechanism comprising a plurality of movable detainers arranged to be set in predetermined relative positions when engaged by a correct key, the detainers serving to block the aforesaid movement of the slide except when they are set in their said predetermined relative positions, said detainers being provided as two sets of pivoted levers within said casing, a first set of said levers being provided with pockets and gates for cooperation with an abutment on the slide so as normally to block the aforesaid movement of the slide, and the second set of said levers being linked to the first set such that pivotal movement of the second set is transmitted into pivotal movement of the first set; the first set of levers being engageable by a correct key when inserted through one of said faces of the casing to pivot those levers into predetermined relative positions in which they permit the movement of the slide; and the second set of levers being engageable by the same correct key when inserted through the opposite face of the casing to pivot those levers such as to pivot the first set of levers into the same predetermined relative positions.

2. A lock according to claim 1 wherein the slide is arranged to pivot the bolts in both senses between their unlocking and locking positions substantially without lost motion between the slide and bolts.

3. A lock according to claim 1 wherein the slide is arranged to pivot the bolts in both senses between their unlocking and locking positions without the application of additional biasing means to influence the movement of the bolts.

4. A lock according to claim 1 wherein the slide includes a head a leading portion of which is thrust against the said first portions of the bolts to pivot the bolts from their unlocking to their locking positions and a trailing portion of which is thrust against the said second portions of the bolts to pivot the bolts from their locking to their unlocking positions; said head being the said portion of the slide which lies between the bolts when the slide is in its second said position.

5. A lock according to claim 4 wherein each said bolt has a recess within which a portion of said head lies when the slide is in its first said position, the leading and trailing margins of said recesses providing the respective said first and second portions of the bolts.

6. A lock according to claim 1 wherein the slide is arranged also to be moved between its second said position and a third position by turning movement of a correct key, during which movement a portion of the slide remains between the bolts to maintain the prevention of pivotal movement of the bolts from their locking to their unlocking positions.

7. A lock according to claim 6 arranged such that a first correct key is effective to move the slide between its first and second said positions and a second correct key, but not the first correct key, is effective to move the slide between its second and third said positions.

8. A lock according to claim 7 wherein said detainers are arranged to be set by said first correct key into first predetermined relative positions in which they permit movement of the slide between its first and second said positions but block movement of the slide from its second to its third position, and are arranged to be set by said second correct key into second predetermined relative positions in which they permit movement of the slide between its second and third said positions but block movement of the slide from its second to its first position.

* * * * *

UNITED STATES PATENT AND TRADEMARK OFFICE

CERTIFICATE OF CORRECTION

PATENT NO. : 4,534,191

DATED : August 13, 1985

INVENTOR(S) : John Rogers; Malcolm J. White

It is certified that error appears in the above-identified patent and that said Letters Patent is hereby corrected as shown below:

In the heading, change the Assignee to:

[73] Assignee: Chubb & Son's Lock and Safe Company, London, England

Column 5, line 35, change "position" to -- positions --

Signed and Sealed this

*Twenty-sixth* Day of *November 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,534,191

DATED : August 13, 1985

INVENTOR(S) : John Rogers et al.

It is certified that error appears in the above-identified patent and that said Letters Patent is hereby corrected as shown below:

On the title page assignee should read

-- (73) Assignee: Chubb & Son's Lock and Safe Company Limited --.

Signed and Sealed this

Fourth Day of February 1986

[SEAL]

*Attest:*

DONALD J. QUIGG

*Attesting Officer*

*Commissioner of Patents and Trademarks*